US006305919B1

(12) United States Patent
Staton et al.

(10) Patent No.: US 6,305,919 B1
(45) **Date of Patent: *Oct. 23, 2001**

(54) HYDRAULIC PUMP HOUSING WITH AN INTEGRAL DAMPENER CHAMBER

(75) Inventors: Timothy Matthew Staton, Ypsilanti; James Richard Robertson, Walled Lake, both of MI (US)

(73) Assignee: Visteon Global Technologies, Inc., Dearborn, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/379,876

(22) Filed: Aug. 24, 1999

(51) Int. Cl.[7] ..... F04B 11/00; F04B 39/00
(52) U.S. Cl. ..... 417/540; 417/312; 417/543
(58) Field of Search ..... 417/312, 540, 417/543; 180/403

(56) References Cited

U.S. PATENT DOCUMENTS

| | | | | |
|---|---|---|---|---|
| 2,311,916 | * | 2/1943 | Wahlmark | 103/223 |
| 2,762,311 | | 9/1956 | Litzenberg . | |
| 2,928,961 | | 3/1960 | Morrill . | |
| 3,203,355 | | 8/1965 | Purcell . | |
| 3,301,192 | | 1/1967 | Morrell . | |
| 3,660,979 | * | 5/1972 | Kamakura et al. | 60/52 |
| 3,790,309 | | 2/1974 | Volz . | |
| 4,401,417 | * | 8/1983 | Davis | 417/300 |
| 4,459,089 | | 7/1984 | Vincent . | |
| 4,470,764 | * | 9/1984 | Anderson et al. | 417/299 |
| 4,507,063 | | 3/1985 | Kemmner . | |
| 4,521,164 | | 6/1985 | Tuckey . | |
| 4,588,360 | | 5/1986 | Tuckey . | |
| 4,752,195 | * | 6/1988 | Friedrich et al. | 417/540 |
| 4,924,670 | * | 5/1990 | Bausch et al. | 60/418 |
| 4,971,527 | | 11/1990 | Dick . | |
| 5,013,221 | | 5/1991 | Tuckey . | |
| 5,071,322 | | 12/1991 | Maekawa . | |
| 5,104,294 | * | 4/1992 | Banba | 417/36 |
| 5,267,840 | | 12/1993 | Snow . | |
| 5,413,468 | | 5/1995 | Tuckey . | |
| 5,595,476 | | 1/1997 | Abel . | |
| 5,692,883 | * | 12/1997 | Voure'h | 417/312 |
| 5,785,013 | | 7/1998 | Sinn . | |

* cited by examiner

*Primary Examiner*—Charles G. Freay
*Assistant Examiner*—Timothy P. Solak
(74) *Attorney, Agent, or Firm*—John E. Kajander

(57) ABSTRACT

A hydraulic pump [14] for an electro-hydraulic power steering system is positioned in a fluid reservoir [16] in a pump housing [12]. The pump [14] has an upstream end [40] that receives fluid from a fluid source and a downstream end [42] that is in communication with fluid expelled from the pump [14]. The pump housing [12] has an integral dampening chamber [36] formed therein adjacent the downstream portion [42] of the pump [14]. The dampening chamber [36] helps minimize pressure pulsations before the fluid is passed through an outlet opening [18] in the housing [12] to a steering gear.

14 Claims, 2 Drawing Sheets

HYDRAULIC PUMP HOUSING WITH AN INTEGRAL DAMPENER CHAMBER

TECHNICAL FIELD

The present invention relates generally to hydraulic pumps. More particularly, the present invention relates to an apparatus for reducing pressure pulses in a hydraulic pump that create fluid borne noise.

BACKGROUND ART

The use of hydraulic pumps, such as power steering pumps, is well known in the automotive industry. Conventional hydraulic pumps, such as those used in power steering systems, are positive displacement pumps. Positive displacement pumps, such as gear pumps, have a pumping action that can create pressure fluctuations in the pump discharge flow. Any variations in this pump discharge flow are converted to pressure pulsations when they encounter circuit resistance. This conversion is referred to in the art as a pressure ripple.

One such example of a positive displacement pump is a vane rotor pump. During normal operation of pumps of this type, pressure pulsations are generated. Each rotation of the pump causes chambers that exist between the vanes to go through two expansion and compression phases, as is well known. The transitions between the expansion and compression phases can create pressure changes in the fluid which can create pressure pulsations. As the fluid is compressed, the pressure in the fluid builds up. This pressure can be different than the pressure in the pumping chamber at the high pressure side of the pump (outlet). Thus, when the compressed fluid at a higher pressure is added to the fluid in the pumping chamber, pressure pulsations can be created as the fluid equalizes in pressure as a whole.

The pressure pulsations transmitted through the fluid can cause resonating (vibrating) of the system components downstream of the pump. These pressure pulsations can also excite structure in the pumping circuit causing them to vibrate and generate additional objectionable noise. For example, if there is grounding of the hoses, i.e., direct contact of the hoses to the vehicle with no isolation, the system can create noises that are unacceptable to the vehicle user.

Typical pressure pulsation noises are tuned out by the use of various tuning methods in the hoses. The utilization of these tuning methods, however, is expensive. Additionally, accumulators have also been used as another possible way to tune out pressure pulsations. The use of accumulations, however, adversely affects the reaction time of the pump. It would therefore be desirable to provide a pump for use in a power steering system that is able to minimize pressure pulsations in an effective, cost efficient manner.

SUMMARY OF THE INVENTION

It is therefore an object of the present invention to provide an apparatus for reducing the pressure pulsations in a power steering system.

It is a further object of the present invention to provide an integral dampening chamber in a pump housing for reducing pressure pulsations.

In accordance with one aspect of the invention, an apparatus for reducing pressure pulsations in a power steering system is provided. The apparatus includes a hydraulic pump for use in a power steering system. The hydraulic pump is positioned within a pump reservoir formed in a pump housing. The pump housing has an upstream portion and a downstream portion. The upstream portion receives fluid from a fluid source and is in communication with a pump inlet. The downstream portion receives fluid expelled from a pump outlet and conveys it to a steering gear. The downstream portion includes a dampening chamber integrally formed in the pump housing which increases the volume of the downstream section allowing fluid expelled from the pump outlet to equalize in pressure whereby pressure pulsations are minimized.

Other objects and features of the present invention will become apparent when viewed in light of the detailed description of the preferred embodiment when taken in conjunction with the attached drawings and appended claims.

DESCRIPTION OF THE PREFERRED EMBODIMENT

Figure 1:
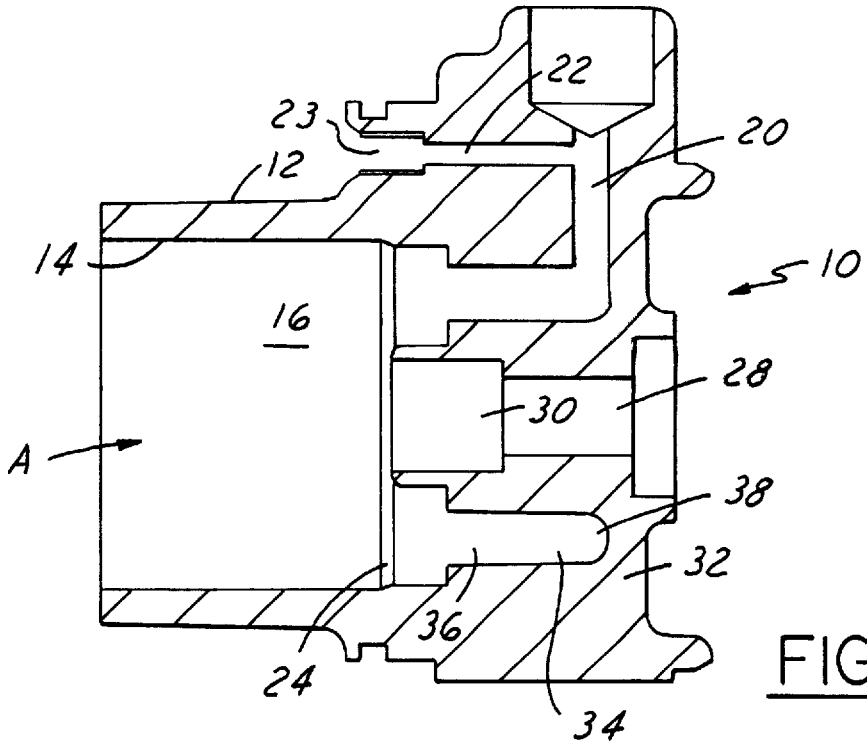
FIG. 1 is a cross-sectional side view of a pump housing having a dampening chamber integrally formed therein in accordance with a preferred embodiment of the present invention.

FIG. 1 illustrates a preferred pump housing 10 in accordance with the present invention. The pump housing 10 has an outer peripheral surface 12 and an inner peripheral surface 14. The inner peripheral surface 14 defines a fluid reservoir 16. The fluid reservoir 16 receives fluid from a fluid source (not shown).

The pump housing 10 includes an outlet opening 18 that expels fluid conveyed from the fluid reservoir 16 through a fluid outlet passageway 20 to a load (not shown). The fluid outlet passageway 20 has a pressure relief passage 22 in communication therewith. The pressure relief passage 22 has a pressure relief valve disposed in a chamber 23 at one end thereof. A pump housing bracket 24 is disposed within the fluid reservoir for engagement with a hydraulic pump 26. The pump housing 10 also includes a shaft passage 28 and a bearing seat 30 for receiving a drive shaft to drive the pump 26 and a bearing to assist in rotation of the shaft. The shaft passage 28 is formed in the motor end 32 of the pump housing 10.

Figure 2:
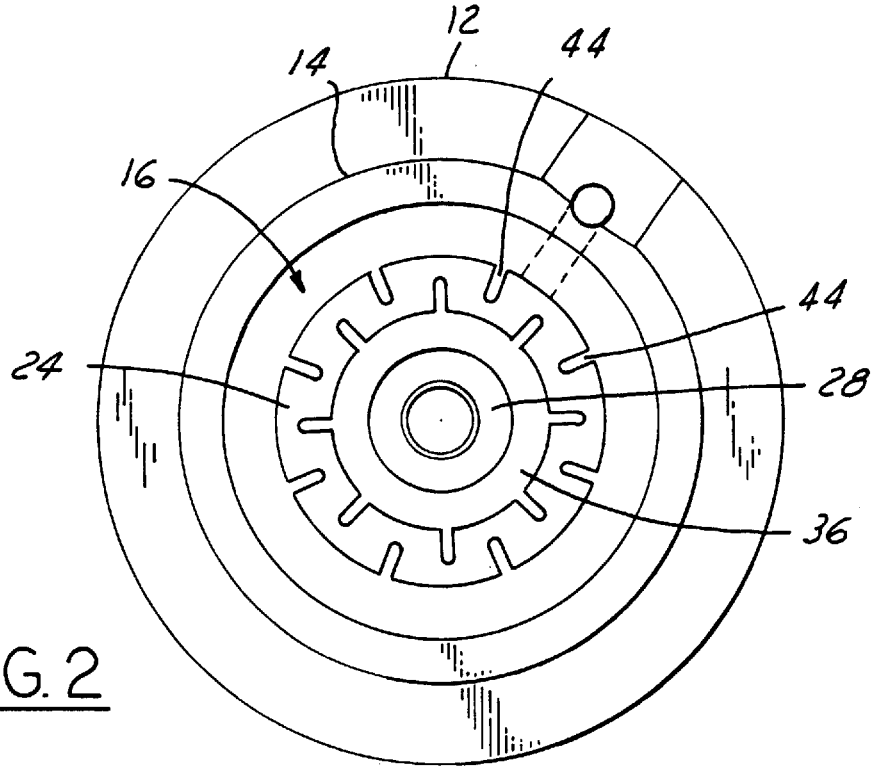
FIG. 2 is an end view of the pump housing of FIG. 1 along the arrow A.

A dampening chamber 34 is preferably integrally formed in the pump housing 10. The dampening chamber 34 is preferably cast into the motor end 32 of the pump housing 10, however it may be formed by other known methods. The dampening chamber 34 includes an annular passage 36 having an arcuate end 38. As shown in FIG. 2, the annular passage 36 extends generally around the periphery of the shaft passage 28 and is in fluid communication with the fluid outlet passage 20.

Figure 3:
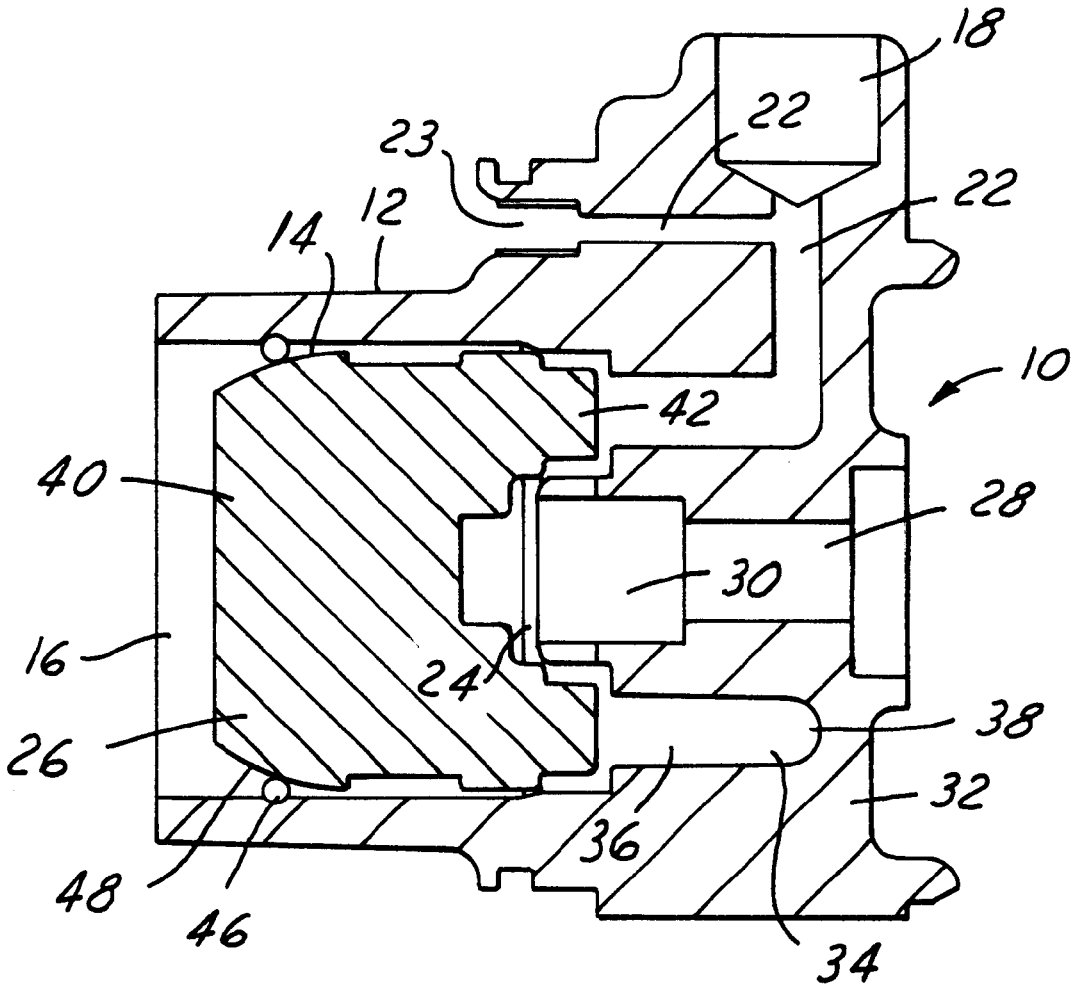
FIG. 3 is a cross-sectional view of a pump housing having a hydraulic pump positioned therein in accordance with a preferred embodiment of the present invention.

As shown in FIG. 3, the hydraulic pump 26 is preferably positioned within the fluid reservoir 16. The pump 26 has an upstream end 40 that is in communication with fluid received from the fluid source and a downstream end 42 that is in communication with the dampening chamber 34 and the outlet opening 18. The downstream end 42 of the pump is preferably mounted on the pump housing bracket 24 through engagement with a plurality of notches 44. Alternatively, a variety of other commercially known engagement apparatus may be utilized. The hydraulic pump 26 is preferably maintained in alignment in the fluid reservoir 16 through the use of a seal 46. The seal preferably contacts the outer periphery 48 of the upstream end 40 of the pump 26 and the inner peripheral surface 14 of the pump housing 10. The seal 46 also prevents leakage of fluid from the upstream end 40 of the pump to the downstream end 42.

The hydraulic pump 10 is preferably a positive displacement pump, such as a gear pump, however any other positive displacement pump may be utilized. The disclosed hydraulic pump 26 is preferably for use in a vehicle power steering system, but may be utilized in a variety of other systems, including non-automotive applications. Further, the preferred hydraulic pump 26 is a vane rotor pump.

The hydraulic pump 26 is in rotational communication with a drive shaft that is passed through the shaft passage 28. The drive shaft is preferably coupled to an electric motor (not shown) such as by a drive coupling or the like to drive the drive shaft. While the motor is preferably an electric motor, a variety of other motors may be utilized.

In operation, fluid is passed into communication with the upstream end 40 of the pump. As the drive shaft is rotated, fluid enters an inlet opening of the hydraulic pump 26 and is forced through an outlet opening in the downstream end 42 of the pump 26. The fluid is then passed into the dampening chamber 34 before exiting the pump housing 10 through the outlet opening 18. The dampening chamber 34 adds increased volume for the fluid exiting the downstream end 42 of the pump 26, such that the pressurized fluid exiting the pump 26 can equalize in pressure with the fluid in the motor end of the pump housing. This helps break up pressure pulses thus reducing noise in the system due to pressure pulsations. Further, the inclusion of the damping chamber allows for little or no tuning in the hoses which reduces the cost of the system.

While particular embodiments of the invention have been shown and described, numerous variations and alternate embodiments will occur to those skilled in the art. Accordingly, it is intended that the invention be limited only in terms of the appended claims.

What is claimed is:

1. A hydraulic pump for use in a vehicle power steering system comprising:

a pump housing having a pump reservoir formed therein;

a pump positioned within said pump reservoir and having an outer periphery in communication with said pump housing to separate said pump housing into an upstream portion and a downstream portion;

said pump conveying fluid from said upstream portion to said downstream portion;

a dampening chamber integrally formed in said downstream portion of said pump housing, for minimizing any pressure pulsations downstream of said pump, said dampening chamber having an annular configuration and having a fixed volume.

2. A hydraulic pump for use in a power steering system, comprising:

a pump housing having a pump reservoir formed therein;

a pump disposed in said pump reservoir, said pump having an outer periphery dividing said pump reservoir into an upstream portion where fluid is received into said pump housing and a downstream portion where fluid is expelled from said pump housing through an outlet passage;

said pump having an upstream end that receives fluid in a pump inlet and expels the fluid through a pump outlet; and a damping chamber integrally formed in said downstream portion of said pump housing, said dampening chamber having a fixed volume that allows fluid expelled from said pump outlet to expand and equalize in pressure prior to exiting said pump housing.

3. The hydraulic pump as recited in claim 2, wherein said dampening chamber is cast into said pump housing.

4. The hydraulic pump as recited in claim 2, wherein said dampening chamber includes a uniform annular passage.

5. The hydraulic pump as recited in claim 2, further comprising:

a pump mount plate positioned in said downstream portion of said pump housing for engaging said pump.

6. The hydraulic pump as recited in claim 2, wherein said pump is sealing positioned in said pump reservoir by an annular seal wedged between an inner periphery of said pump housing and an outer periphery of said pump, to prevent fluid from leaking from said upstream portion to said downstream portion around said outer periphery of said pump.

7. The hydraulic pump as recited in claim 2, wherein said outlet passage conveys fluid from said downstream portion of said pump housing to a steering gear.

8. The hydraulic pump as recited in claim 7, wherein said pump is incorporated into an electro-hydraulic power steering system.

9. An electro-hydraulic power assist steering system for an automobile, comprising:

a hydraulic pump;

an electric motor coupled to said hydraulic pump for driving said pump;

said hydraulic pump having an upstream end and a downstream end;

a pump housing having a pump reservoir within which said hydraulic pump is disposed, said pump housing having an inner peripheral surface and an outer peripheral surface;

an annular seal wedged between said inner peripheral surface of said pump housing and said hydraulic pump such that an outer peripheral surface of said hydraulic pump divides said pump housing into an upstream end and a downstream end;

a fixed volume dampening chamber integrally formed in said downstream end of said pump housing and in direct fluid communication with an outlet passage; and whereby any pressure pulsations in fluid expelled from said downstream end of said pump are minimized.

10. The electro-hydraulic power assist steering system as recited in claim 9, further comprising:

a pump bracket received in said pump reservoir for retaining said hydraulic pump in proper alignment in said pump housing.

11. The electro-hydraulic power assist steering system as recited in claim 9, wherein said dampening chamber is cast in said pump housing.

12. The electro-hydraulic power assist steering system as recited in claim 11, wherein said dampening chamber includes a uniform annular passage.

13. The electro-hydraulic power assist steering system as recited in claim 11, wherein a drive shaft passage is formed in said pump housing for passage of a drive shaft which is coupled to said electric motor.

14. The electro-hydraulic power assist steering system as recited in claim 13, wherein said dampening chamber is formed around said drive shaft passage.

* * * * *